US006385415B1

(12) United States Patent
Hilbert et al.

(10) Patent No.: US 6,385,415 B1
(45) Date of Patent: May 7, 2002

(54) DEVELOPMENT STATION FOR A REPRODUCTION APPARATUS

(75) Inventors: Thomas Kurt Hilbert, Spencerport; Jerry Eugene Livadas, Rochester; Scott Thomas Slattery, Brockport; Patricia D. Reuschle, Rochester; Gary Edwin Nichols, Fairport; Michelle Dawn Wise, Hamlin; Cathlyn Y. Yu, Penfield; Donald Steven Hensel, Rochester; Daniel Francis Vespone, Rochester; Christopher Stephen Garcia, Rochester; Thomas Samuel Albrecht, Rochester; Michael E. Jacobs, Rochester; James Robert Carey, Rochester; W. Charles Kasiske, Penfield; Timothy Gilbert Armstrong; D. Steven Kepner, both of Rochester, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/573,903

(22) Filed: May 18, 2000

(51) Int. Cl.[7] ..... G03G 15/08; G03G 15/09

(52) U.S. Cl. ..... 399/104; 399/98; 399/103; 399/119; 399/258

(58) Field of Search ..... 399/102, 103, 399/104, 105, 106, 119, 256, 258, 98, 99; 220/258

(56) References Cited

U.S. PATENT DOCUMENTS 5,166,731 A * 11/1992 Aimoto et al. ..... 399/103
5,177,536 A * 1/1993 Watanabe et al. ..... 399/222
5,305,064 A * 4/1994 Trott et al. ..... 399/258
5,596,392 A * 1/1997 Danzuka ..... 399/98
5,887,227 A * 3/1999 Kawai et al. ..... 399/98
5,946,530 A * 8/1999 Tsuji et al. ..... 399/103

FOREIGN PATENT DOCUMENTS

JP 60-151668 * 8/1985

* cited by examiner

*Primary Examiner*—Sophia S. Chen
(74) *Attorney, Agent, or Firm*—Lawrence P. Kessler

(57) ABSTRACT

A magnetic brush development station for a reproduction apparatus. The magnetic brush development station includes a housing forming, at least in part, a reservoir for developer material. The reservoir has a pressure equalization seal. A mechanism is associated with the housing for readily moving the housing relative to the reproduction apparatus. Another mechanism selectively readily replenishes and/or empties at least one component of developer material with respect to the reservoir. A plurality of augers are located in the housing for mixing developer material within the reservoir. A drive for the augers, extending through the housing, has a seal therefor. A development roller, mounted within the housing, delivers developer material from the reservoir to a development zone. The development roller includes a core magnet inside a shell such that the core magnet and the shell having relative rotation. The core magnet extends less than the entire length of the development roller such that the developer nap on the shell does not extend to the end of the development roller. A metering skive, extending the length of the development roller, controls the quantity of developer material delivered from the reservoir portion of the housing to the development zone. The metering skive is positioned parallel to the longitudinal axis of the development roller at a location upstream in the direction of shell rotation prior to the development zone. Further, a magnetic seal is located in association with the skive at each end of the development roller. The magnetic field of the magnetic seal is sufficient to substantially prevent leakage of developer material from the ends of the development roller.

5 Claims, 18 Drawing Sheets

DEVELOPMENT STATION FOR A REPRODUCTION APPARATUS

FIELD OF THE INVENTION

This invention relates in general to a development station for a reproduction apparatus, and more particularly to a reproduction apparatus magnetic brush development station.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of development station commonly utilized in electrographic reproduction apparatus is the magnetic brush development station. The magnetic brush development station includes a housing providing a reservoir for a supply of developer material. The developer material may be, for example, two-component material comprising magnetic carrier particles and relatively smaller pigmented marking particles. A mechanism, such as a paddle wheel, auger, or ribbon blender, is located in the reservoir and serves to stir the carrier particles and marking particles to triboelectrically charge the particles so that the marking particles adhere to the surface of the carrier particles. A transport mechanism brings the developer material into the field of a plurality of magnets within a rotating sleeve (commonly referred to as a toning roller). The rotating sleeve and magnetic field cause the marking particles to be brought into the vicinity of the latent image charge patterns on the dielectric support member to be applied to the latent image charge patterns in order to develop such patterns.

While magnetic brush development stations of the above described type are generally suitable for operation in present commercial reproduction apparatus, improvements in speed a range of use escalate the demands on all of the systems of the reproduction apparatus, especially the development station. For example, such magnetic brush development stations may create apparatus problems by the increased generation and control of marking particles dust. There can be several sources of marking particles dusting. Marking particle dust, if not sufficiently contained, can result in negative effects on image quality, reliability, and cost of ownership. That is to say, image quality is affected when other subsystems within the reproduction apparatus are contaminated with marking particle dust. For example, contamination of chargers results in non-uniform image densities due to non-uniform charging. Contamination of the exposure apparatus causes a non-uniform latent image and results in non-uniform image densities. Reliability can be effected when marking particles contaminates drive components, seals, and circuit boards. Increased customer and/or service personnel time to clean these components reduces the available up-time and productivity of the equipment.

In modern reproduction apparatus, reduction in the amount of marking particle dust generated has mostly been accomplished via materials changes to the carrier and/or marking particles. Mechanical changes that could be significant in reducing dust generation, i.e. core and shell speeds, also have the disadvantage of reducing development efficiency. Therefore, dust containment strategies have been actively pursued. Developer station dust containment strategies can consist of either active or passive controls. In most cases, a combination of these two techniques results in the best performance. Active controls generally are more complex, have impacts on other subsystems, need to be designed at the larger reproduction apparatus level, generate audible noise, and are more costly. These types of controls if not implemented correctly could influence air-flows within the system, cause additional reliability problems, or result in reduced marking particles yield. Passive controls are implemented at the subsystem level and have a reduced probability of influencing other subsystems. The simplest of passive fixes come in the form of seals or attempts at redirection of airflow in or around the development hardware.

One of the significant problems with the previously mentioned technologies is the generation of heat caused by the seal contacting the development roll surface. Other potential problems include, wear of the seal material, non-uniform contact of the seal material, contamination of the developer, etc. Generation of heat at or around the development roll surface has a high probability of generating marking particles flakes, which are unacceptable in high quality color digital imaging systems. Implementation of a magnetic seal that extends around at least a portion of the development roll, as described in U.S. Pat. No. 5,472,875, has the potential disadvantage of disrupting the material flow characteristics within the development housing.

SUMMARY OF THE INVENTION

In view of the above, this invention is directed to a magnetic brush development station for a reproduction the magnetic brush development station includes:

- a housing forming, at least in part, a reservoir for developer material, the reservoir having a pressure equalization seal;
- a mechanism, associated with the housing for readily moving the housing relative to the reproduction apparatus;
- a mechanism for selectively readily replenishing and/or emptying at least one component of developer material with respect to the reservoir,
- a plurality of augers located in the housing for mixing developer material within the reservoir, a drive for the augers, the drive extending through the housing and having a seal therefor;
- a development roller mounted within the housing for delivering developer material from the reservoir to a development zone, the development roller including a core magnet inside a shell, the core magnet and the shell having relative rotation, the core magnet extending less than the entire length of the development roller such that the developer nap on the shell does not extend to the end of the development roller;
- a metering skive, extending the length of the development roller, for controlling the quantity of developer material delivered from the reservoir portion of the housing to the development zone, the metering skive positioned parallel to the longitudinal axis of the development roller at a location upstream in the direction of shell rotation prior to the development zone; and a magnetic seal located in association with the skive at each end of the development roller, the magnetic field of the magnetic seal being sufficient to substantially prevent leakage of developer material from the ends of the development roller.

The invention disclosed here is a passive sealing technique that a) prevents airborne marking particles from escaping the developer sump and b) prevents marking particles from building up on the developer roll surface. The magnetic seal is made using a properly positioned magnet and developer already contained within the sump.

Preventing airborne marking particles from leaving the sump: The rotation of the development shell creates a flow of air that can pump airborne marking particles out of the developer sump. The development nap does not extend to the ends of the development roller. Hence a gap exists between the developer roller and the metering skive, allowing marking particles to escape via the air stream generated by the development roller. This magnetic seal is positioned near this gap to effectively seal marking particles in the sump.

Preventing marking particles from building up on the developer roll surface: In the pre-development zone region, fiber seals are used to contain marking particles dust. The developer nap/PC interface creates another seal. However, outside the developer nap, gaps between the development roll and PC allow airborne marking particles to migrate towards the ends of the development roller, can collect and build up on the development roll surface. If significant marking particles collects on the roller circumference, it can interfere with other surfaces, generate heat and produce flakes. The magnetic seal also serves to perform continuous wiping of the roller circumference.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

Figure 1:
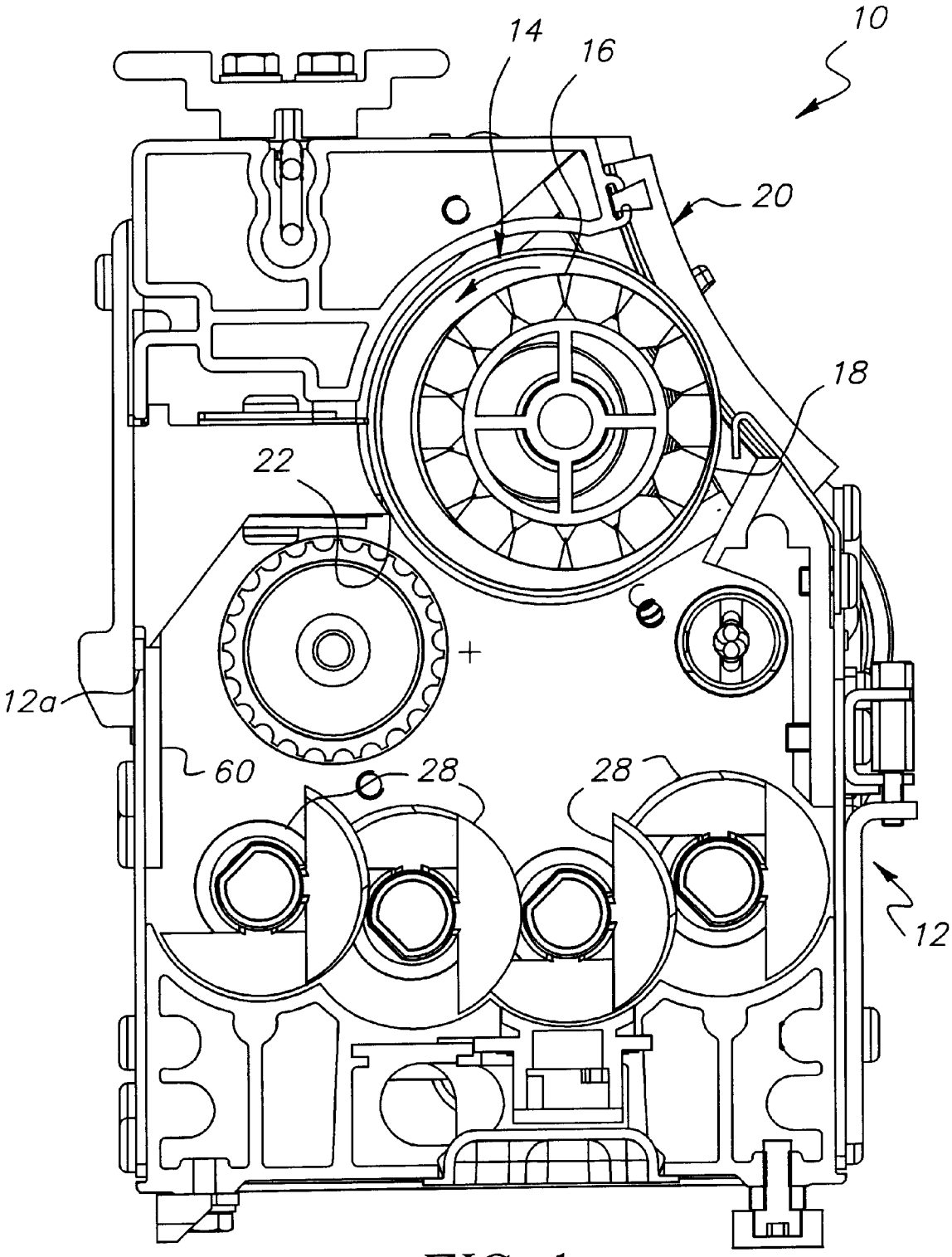
FIG. 1 is a side elevational view, in cross-section, of a reproduction apparatus magnetic brush developer station according to this invention.
Figure 12:
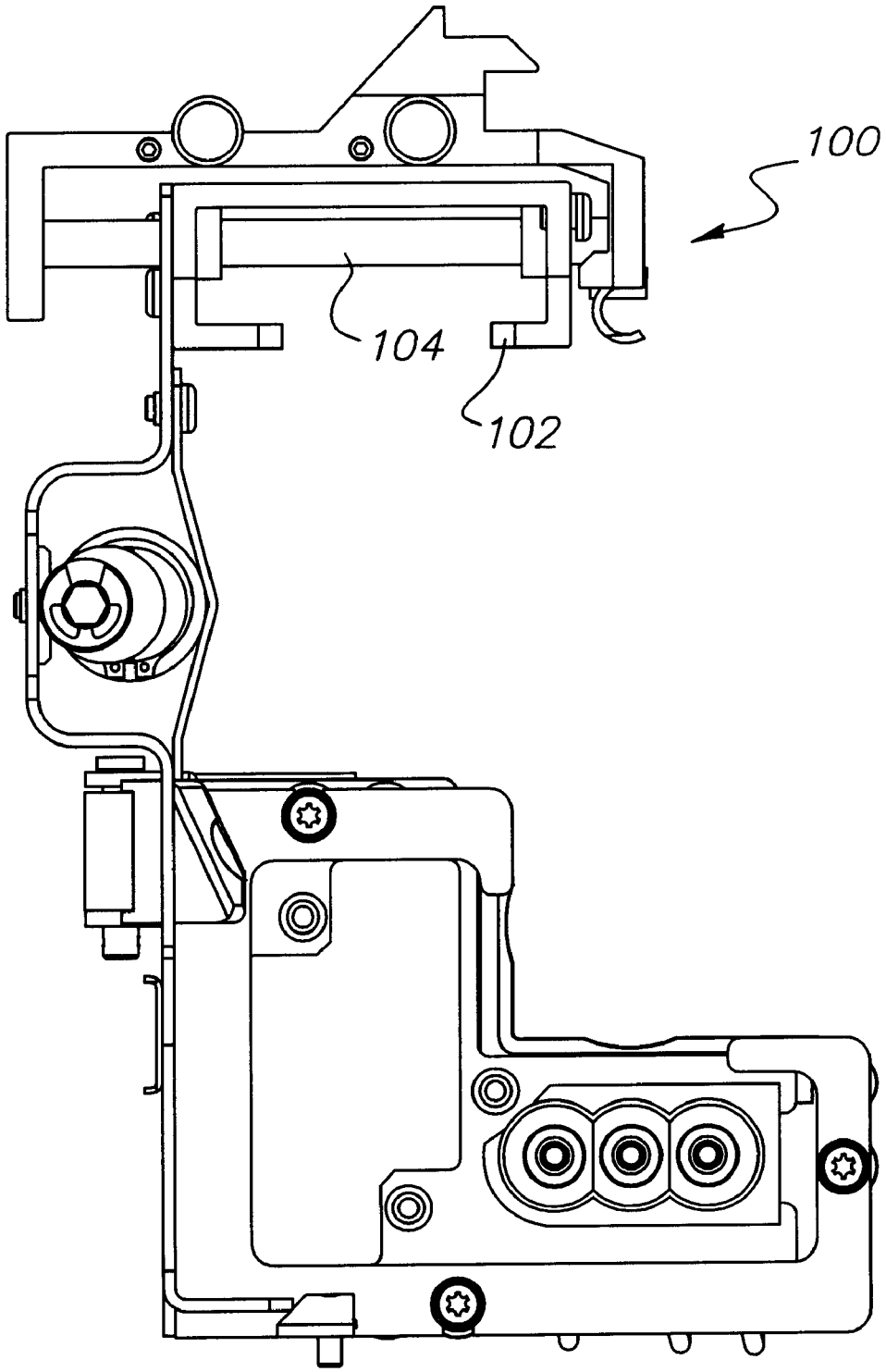
Figure 13:
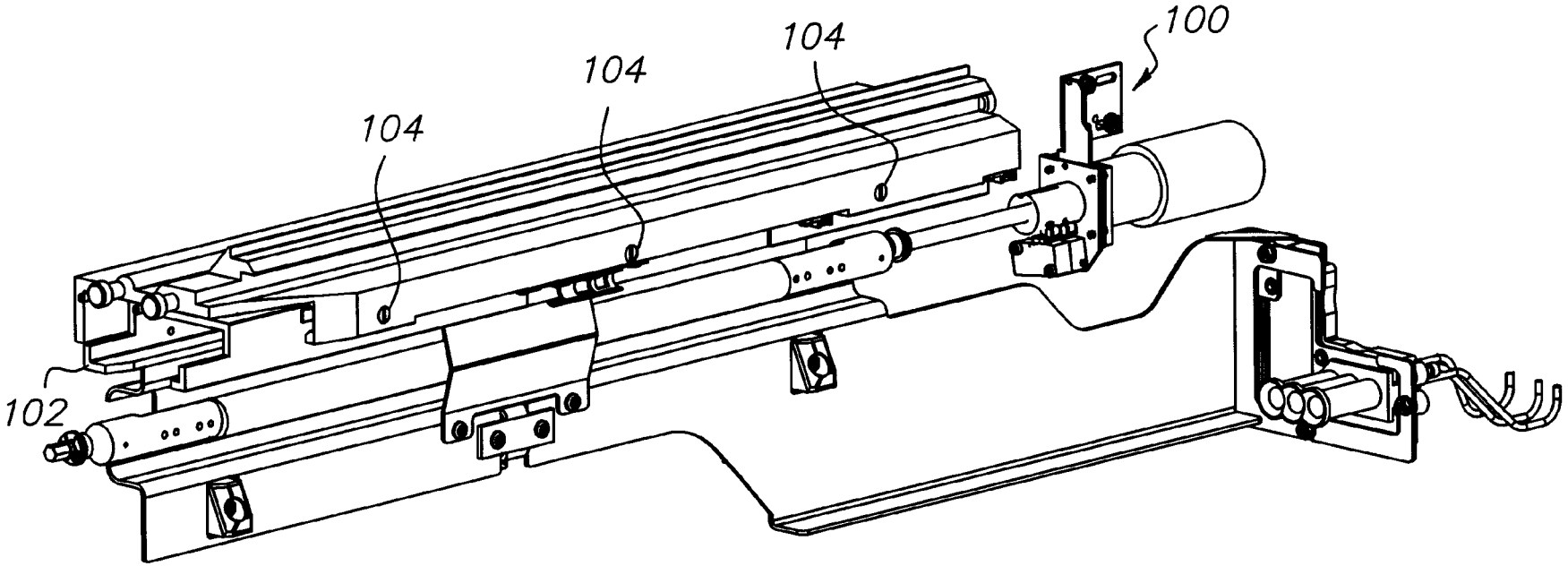
Figure 14:
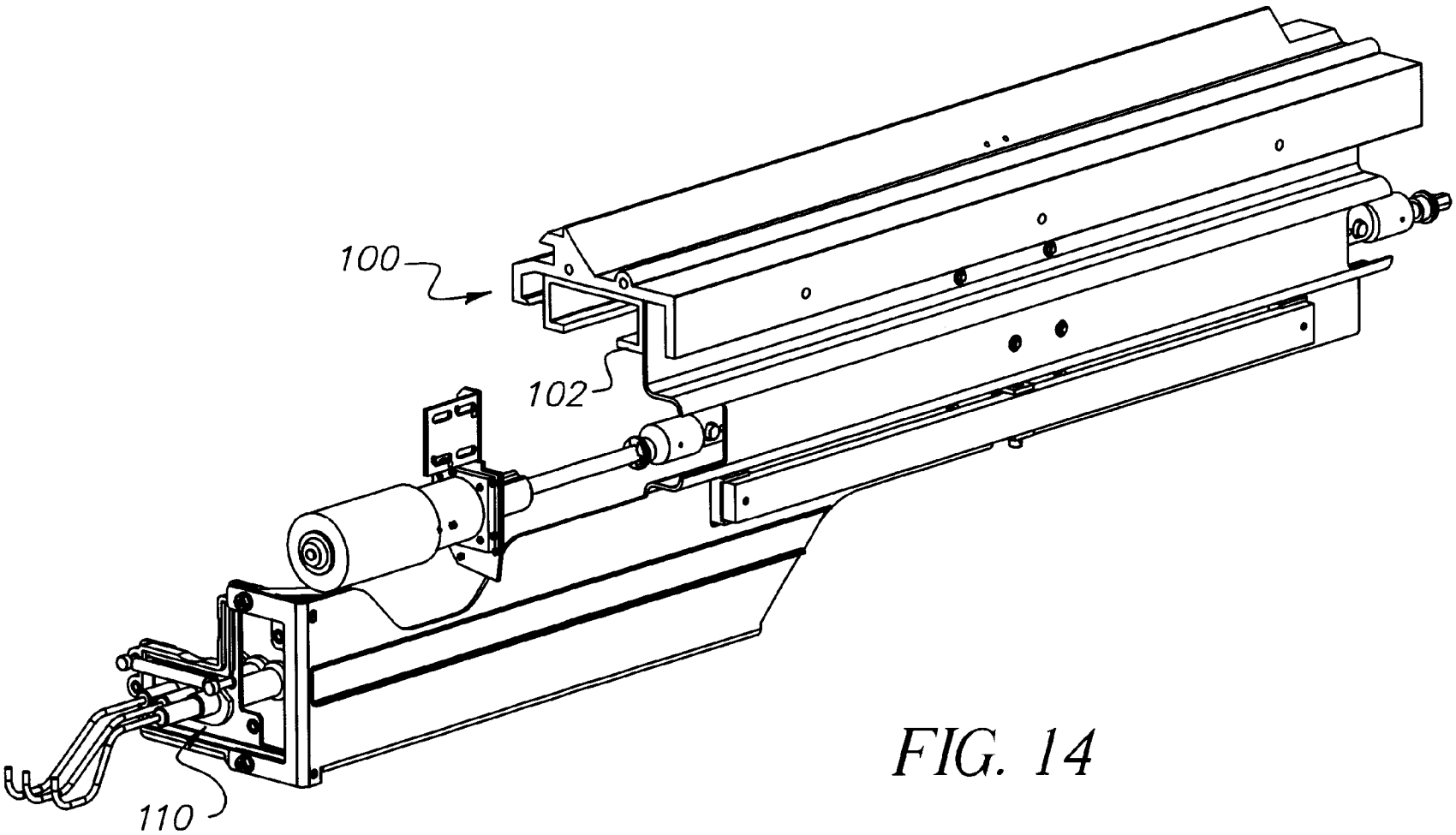
Figure 15:
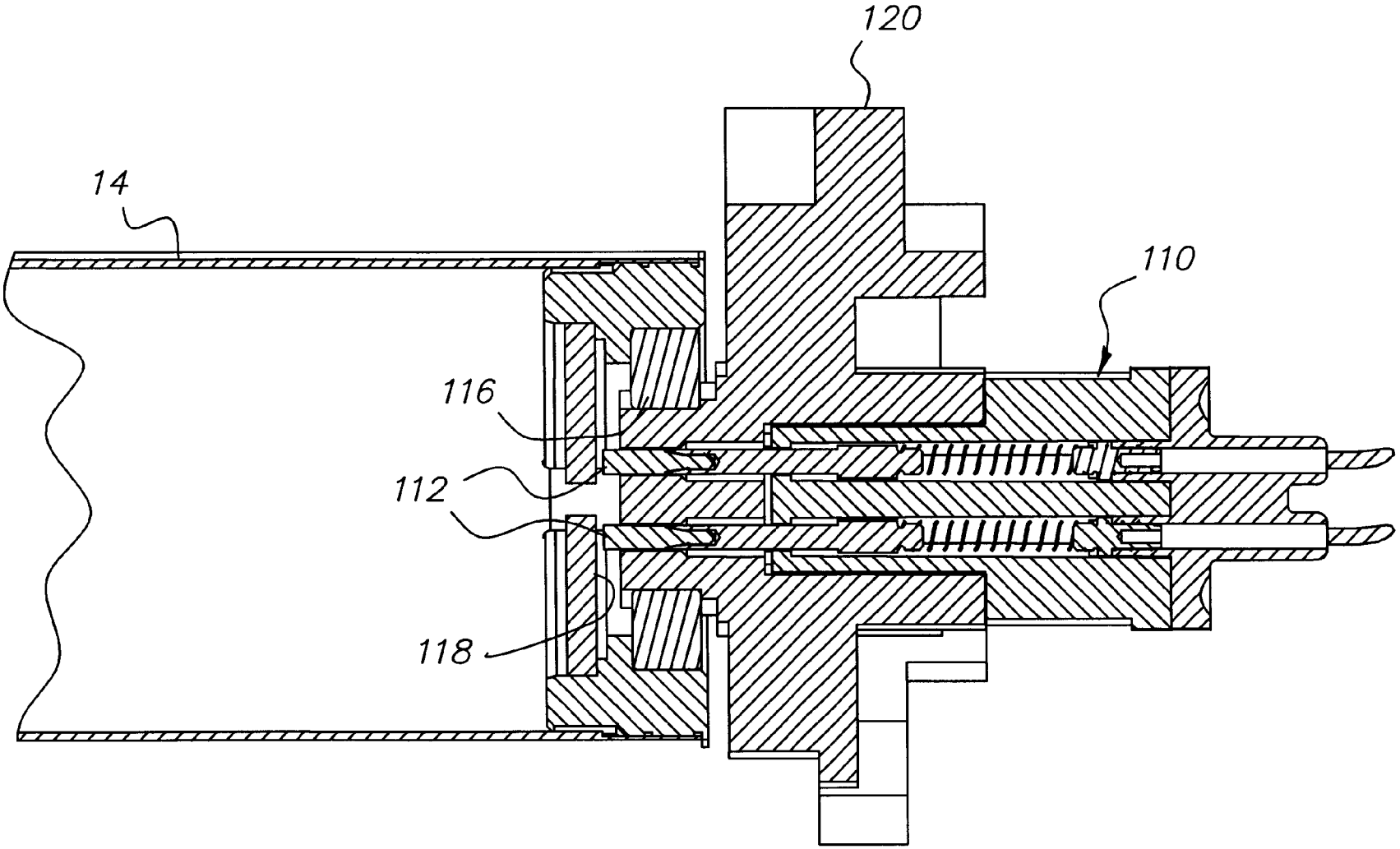
Figure 16:
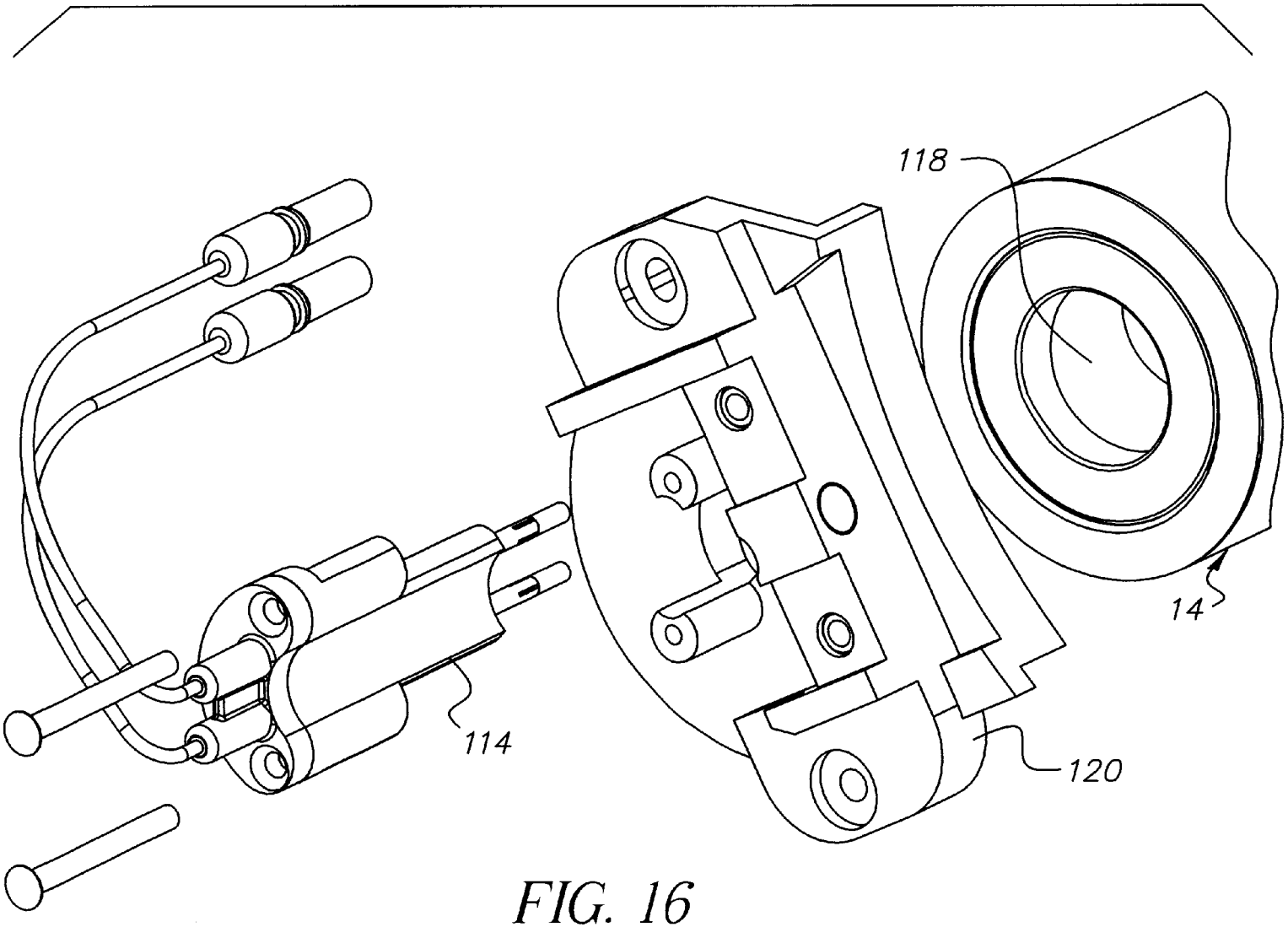
Figure 17:
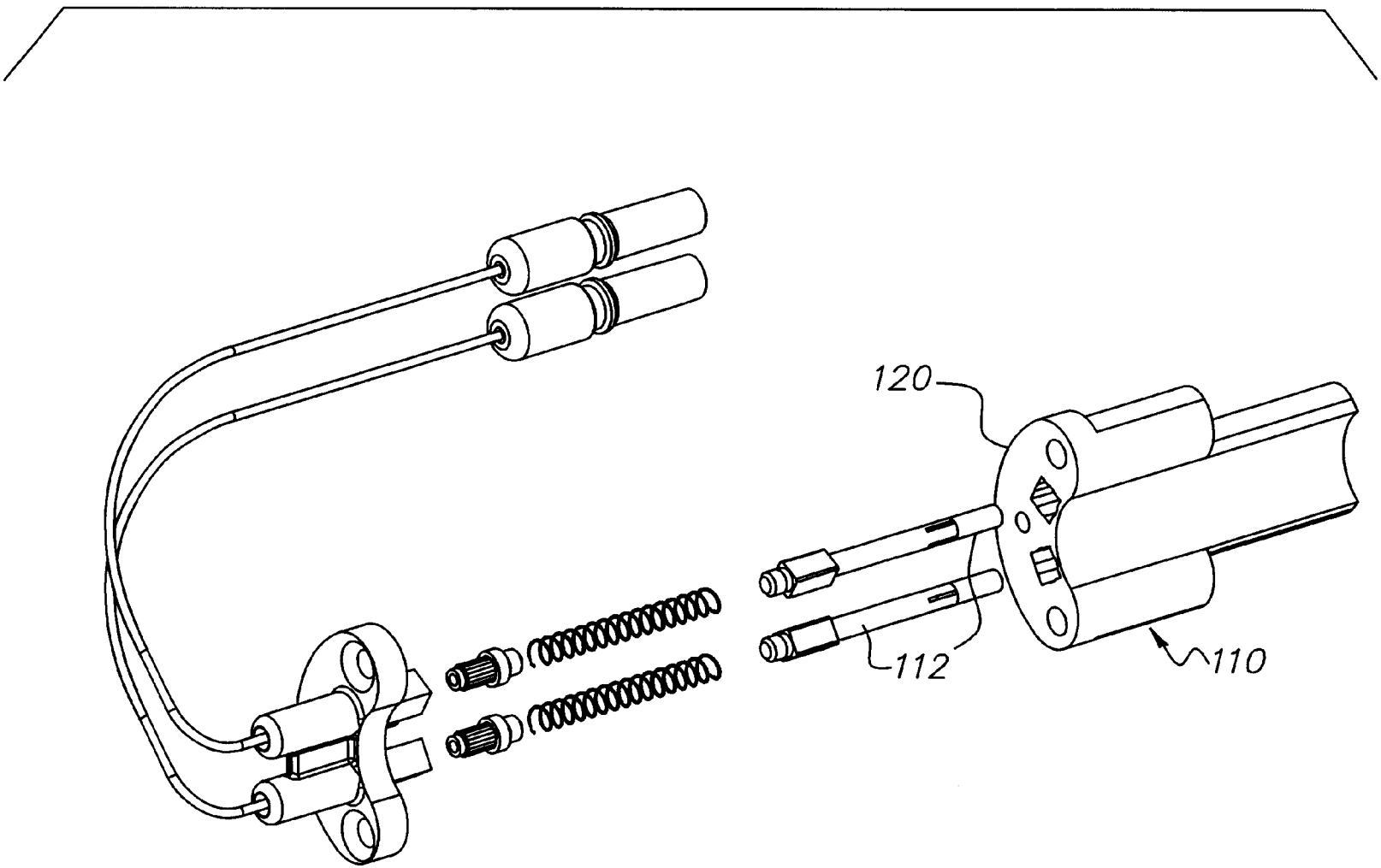
Figure 18:
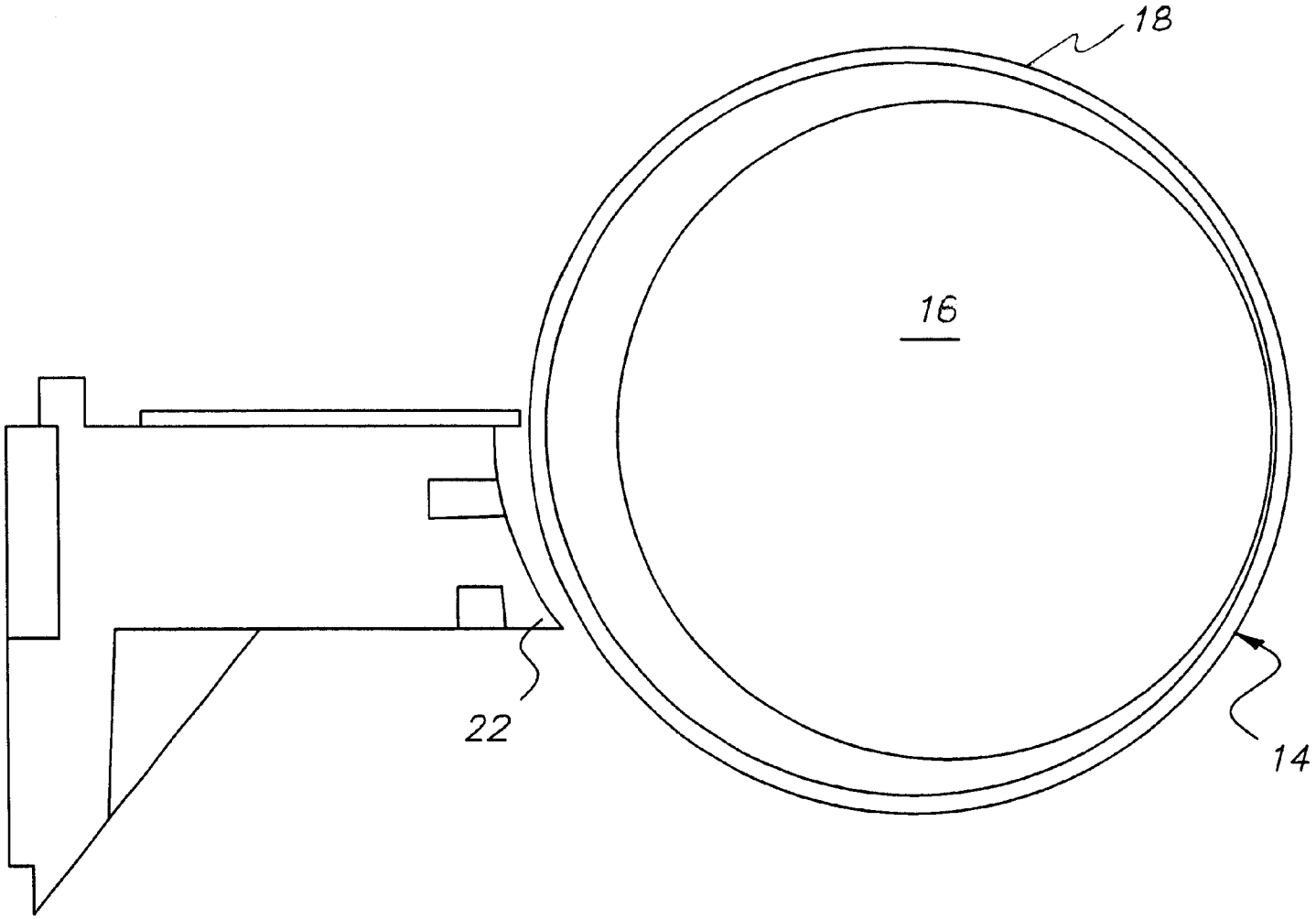

FIG,. 12 is a side elevational view of the carriage assembly for the magnetic brush development station of FIG. 1;

FIGS. 13 and 14 are views, in perspective, of the carriage assembly of FIG. 12;

FIG. 15 is a front elevational view, in cross-section, of a bias brush assembly for the magnetic brush developer station of FIG. 1;

FIGS. 16 and 17 are respective exploded views, in perspective, of the bias brush assembly of FIG. 15; and FIG. 18 is an end view, partly in cross-section, of an alternate developer material skive mechanism for the magnetic brush development station according to this invention.

DETAILED DESCRIPTION OF THE INVENTION

Figure 3:
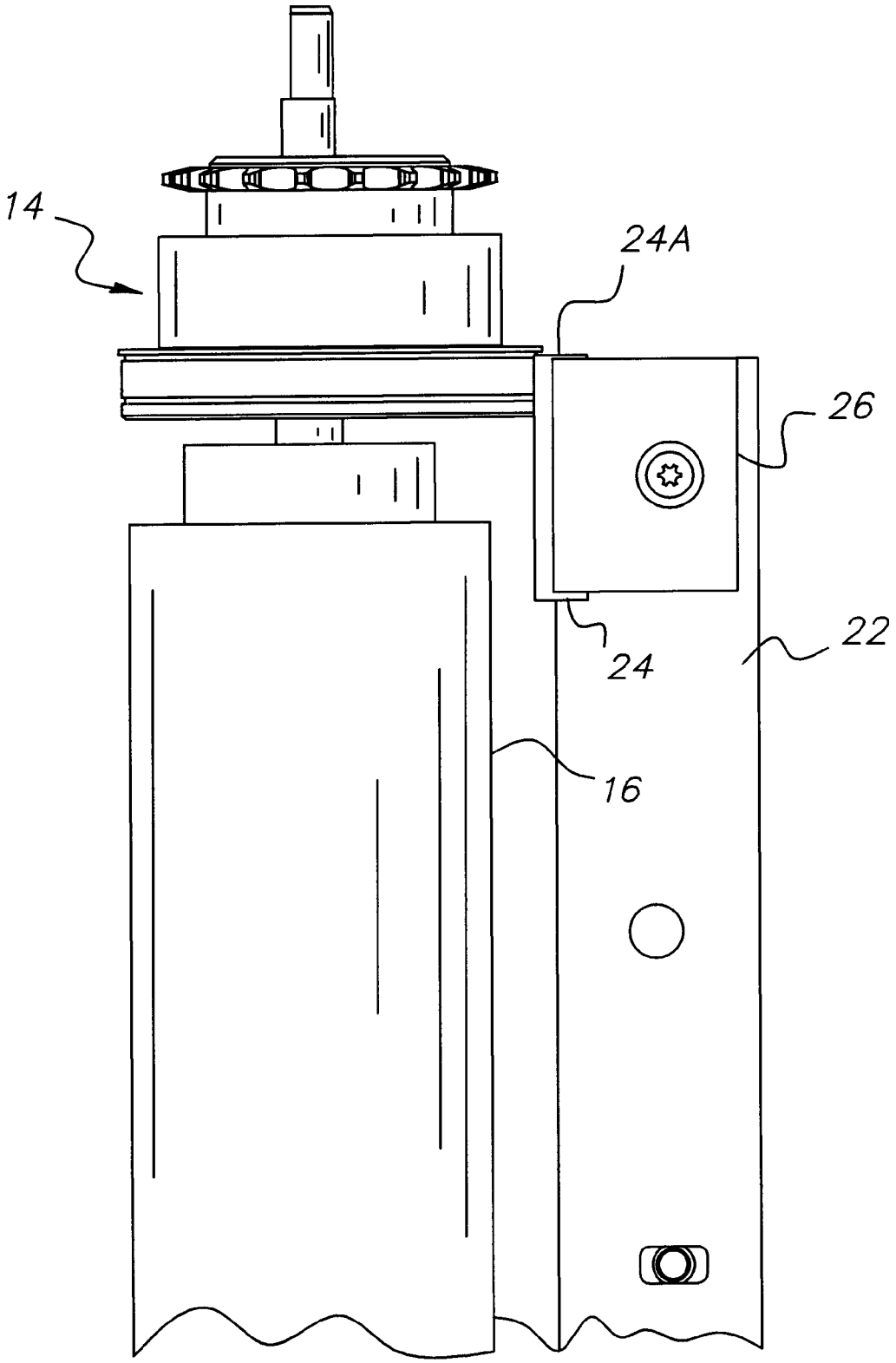
FIG. 3 is a bottom view, partly in cross-section and on an enlarged scale, of a portion of the development roller and metering skive of FIG. 2, particularly showing the magnetic seal according to this invention.
Figure 6:
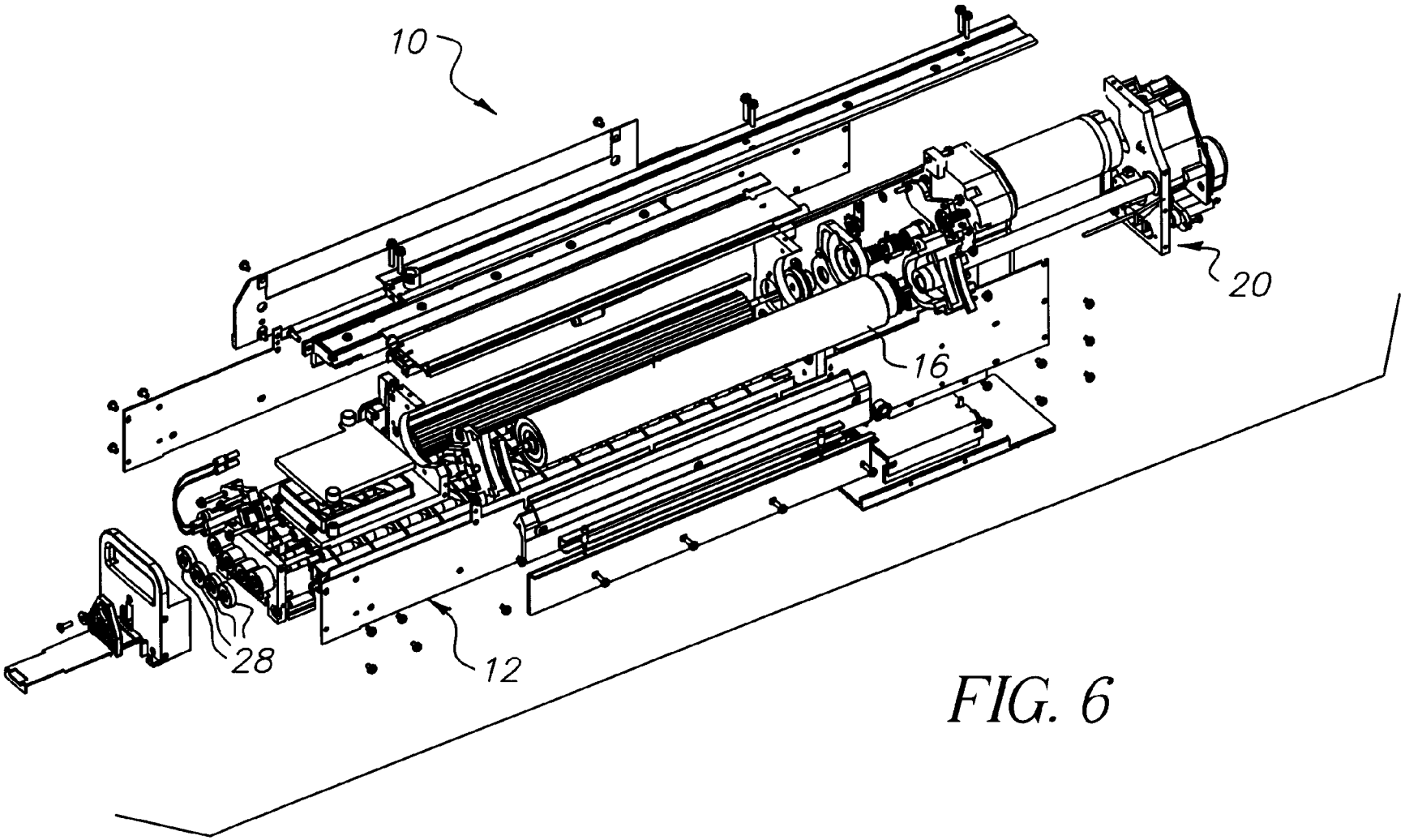
FIG. 6 is an exploded view, in perspective, of the magnetic brush development station of FIG. 1.

Referring now to the accompanying drawings, FIG. 1 (and exploded view FIG. 6) shows a reproduction apparatus magnetic brush developer station, according to this invention, designated generally by the numeral 10. The magnetic brush development station 10 includes a housing 12 forming, in part, a reservoir for developer material. A plurality of augers 28, having suitable mixing paddles, stir the developer material within the reservoir of the housing 12. A development roller 14, mounted within the development station housing 12, includes a rotating (counterclockwise in FIG. 1) fourteen pole core magnet 16 inside a rotating (clockwise in FIG. 1) shell 18. Of course, the core magnet 16 and the shell can have any other suitable relative rotation. The quantity of developer material delivered from the reservoir portion of the housing 12 to the development zone 20 is controlled by a metering skive 22, positioned parallel to the longitudinal axis of the development roller 14, at a location upstream in the direction of shell rotation prior to the development zone. The metering skive 22 extends the length of the development roller 14 (see FIG. 3). The core magnet 16 does not extend the entire length of the development roller; as such, the developer nap on the shell 18 does not extend to the end of the development roller.

Figure 2:
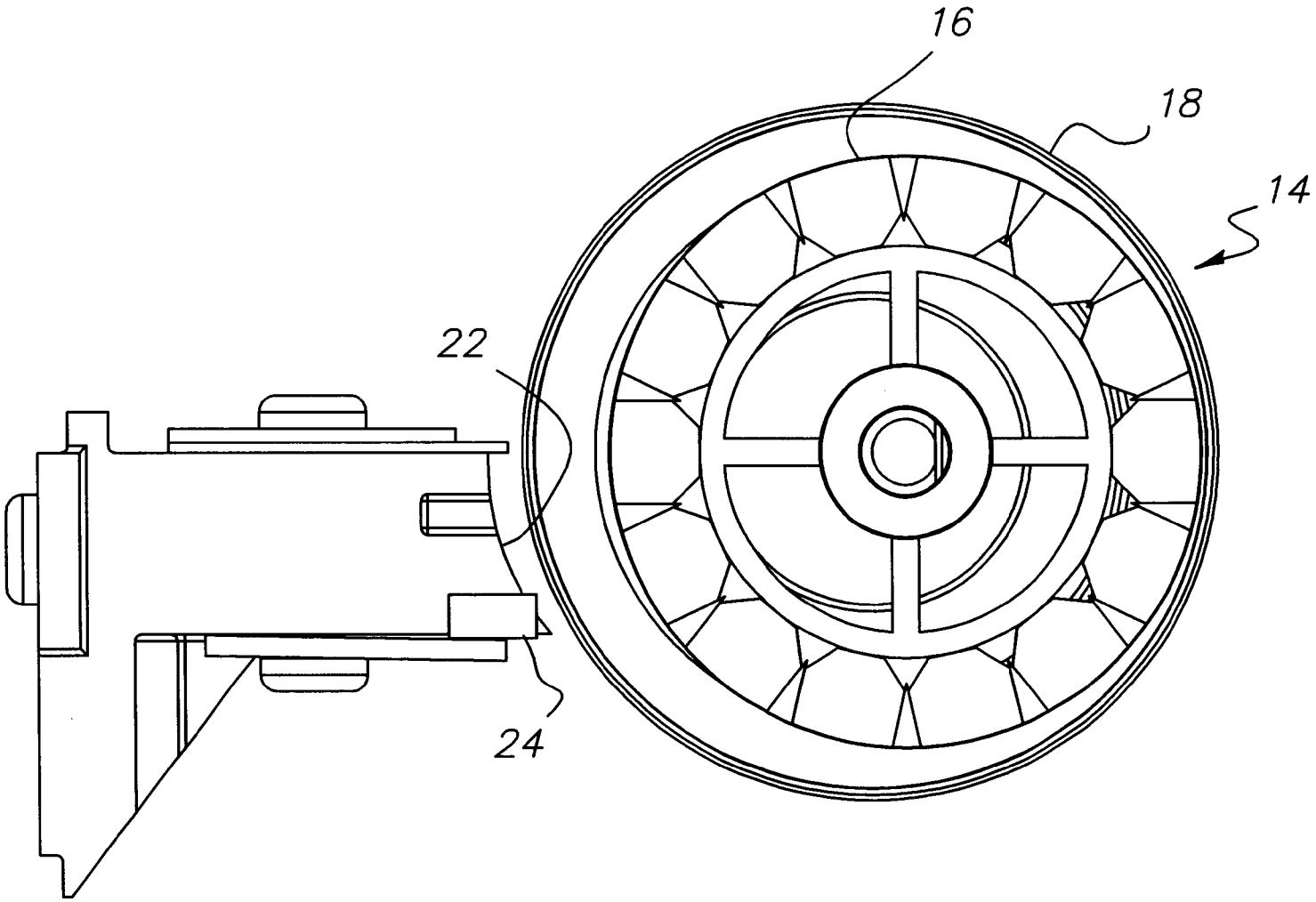
FIG. 2 is an end view, partly in cross-section and on an enlarged scale, of the development roller and metering skive of the magnetic brush development station of FIG. 1.

At each end of the development roller 14, a single pole permanent ceramic magnet 24 is used (one end shown in FIGS. 2 and 3) as a seal to prevent leakage of developer material from the ends of the development roller. The magnet 24 is selected to provide a magnetic field with a strength in the range of 400 to 1200 gauss, and preferably 900 gauss. One end 24*a* of the magnet 24 is approximately flush with the end of the development roller 14 and extends along the longitudinal axis of the development roller such that an overlap (approximately 10 mm) exists with the roller. The single pole magnet 24 is secured to the underside of the mount for the metering skive 22 by a metal plate and fastener 26 with the active pole of the magnet in close proximity to the developer roller circumference. The metal plate 26 functions to shunt the magnetic field except in the area of the magnet 24 which faces the developer roller 14.

It is apparent that the magnet 24 as described above provides an effective seal preventing developer material from escaping from the ends of the developer roller. Since this seal does not have any moving parts, there is no wear, and there is no mechanical friction which would generate heat and create undesirable developer material flakes. Moreover, there is no seal material which would wear and contaminate the developer material.

Figure 4:
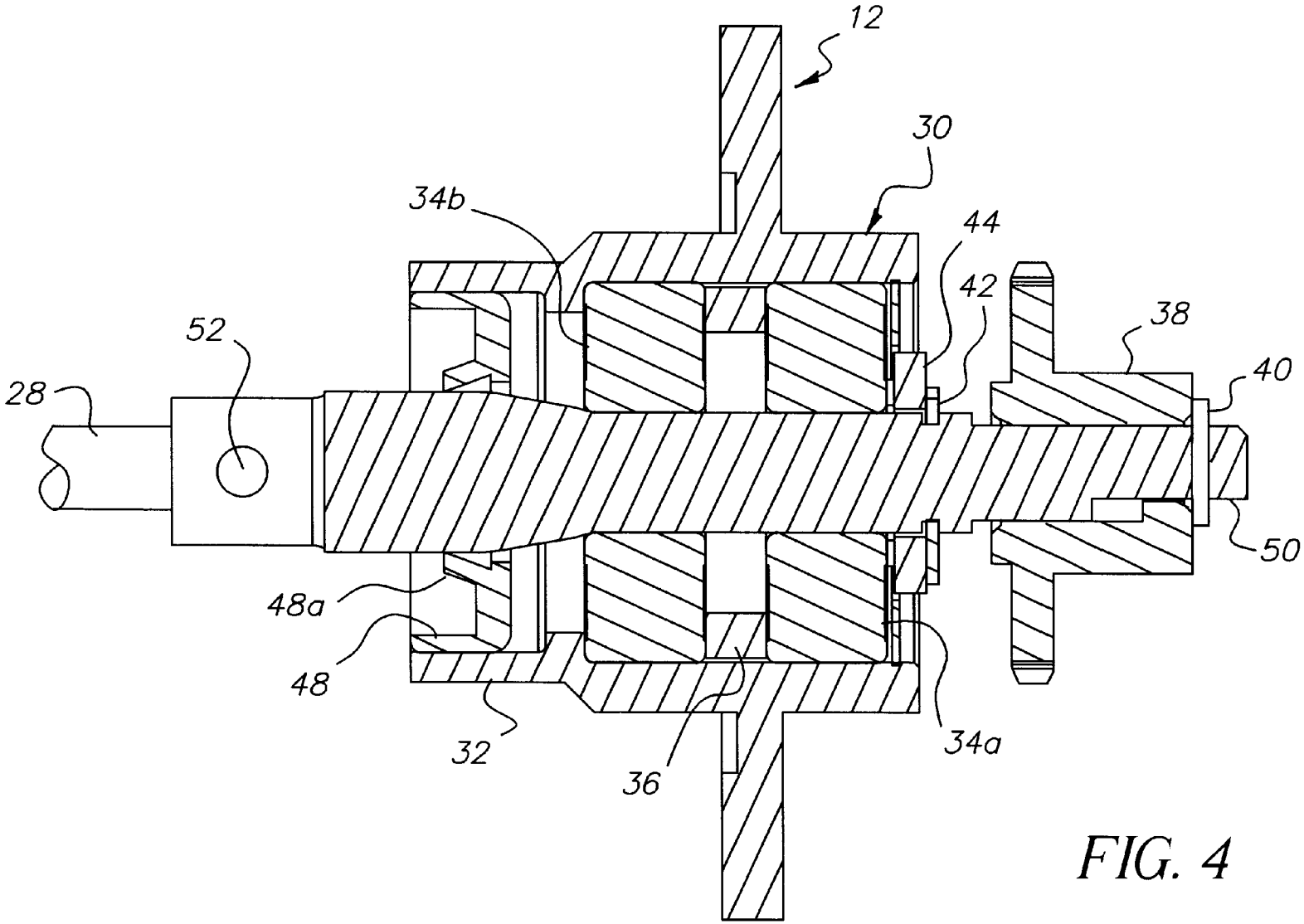
FIG. 4 is a side elevational view, in cross-section and on an enlarged scale, of a bearing and seal assembly for the auger shaft of the magnetic brush development station of FIG. 1.
Figure 5:
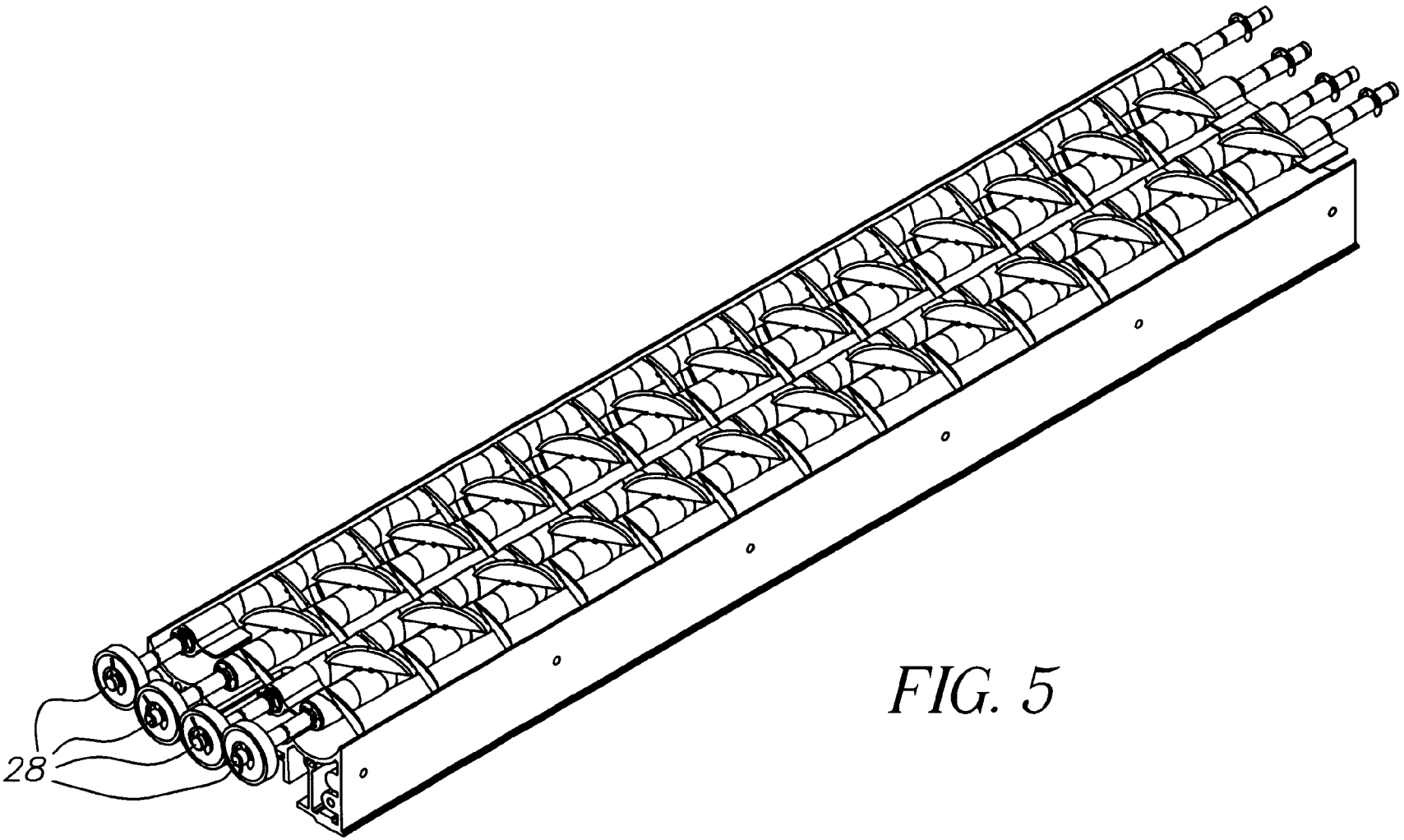
FIG. 5 is a view, in perspective, of the mixing augers of the magnetic brush development station of FIG. 1.

To further prevent development material from escaping from the development station housing 12, there is provided an easily serviced assembly 30 (see FIG. 4) for the drive-shaft of the augers 28. The assembly 30 includes a substantially cylindrical housing 32 extending through the development station housing 12 (adjacent to the location of the augers 28 shown in FIG. 1). Two bearings 34*a*, 34*b* are positioned in the cylindrical housing 32 with a spacer 36 between the bearings. An auger drive member 38, two e-rings 40, 42, an additional spacer 44, and wavy washer and a sealing member 48 surround a rotatable shaft 50 connected to an auger 28 for transporting developer material within the development station housing reservoir. The sealing member 48 includes a lip seal 48*a* formed of a material which is able to stretch sufficiently to maintain contact with shaft 50 while the shaft is being rotated by the drive member 38. This assembly is robust to wear and any heat generation. The two bearings with a spacer in between are used so as to maintain minimum radial movement of the shaft 50. The shaft includes a feature used for drive rotation and also a yoke to accept the end of the marking particles delivery auger. The shaft is hardened and ground to reduce wear and heat generation at the seal interface. The auger 28 is attached to the shaft 50 removeably with a pin 52 that is captured in either side of the yoke of the shaft feature. The washer and e-rings complete the assembly 30 and hold it together, and can be removed by disassembling any drive mechanism, and then removing the assembly.

The development station housing 12 has a membrane-type seal 60 placed over a hole 12*a* in the side wall of the housing. The seal 60 serves the purpose of providing pressure equalization within the housing. The surface area of the seal is selected to provide sufficient pressure equalization efficiency. The seal 60 allows air flow, caused by pressure differential between inside the housing 12 and the exterior thereof, through the membrane without carrying developer material dust out of the housing. The seal is located in such a position as to cause developer material in the housing to continuously be moving across the membrane surface to continuously clean the membrane seal to maintain the efficient operation thereof.

It should be noted that, as the reproduction apparatus market has evolved from black and white copiers to process color printers, more development stations needed to be fit into essentially the same amount of machine space. To do this a more compact station was needed that would still adequately mix developer material and hold as large a developer material volume as possible. The increased station capacity was desired to increase the time between developer material replenishment and changes. Also, the larger volume of developer material would allow for higher takeout rates of marking particles while removing a smaller percentage of the available particles. The solution has been to increase the development station housing reservoir "floor" space and add additional augers to keep the developer material well mixed. The magnetic brush development station 10, according to this invention, uses four augers 28 (see FIG. 1), although a different number could be used. The augers on the outsides are raised and moved towards the center slightly. This reduces the width of the station while maintaining centerline distances so that the auger paddles do not collide. The increase reservoir capacity has two main advantages, it increases the time between developer changes, and allows for a longer dwell time of developer material in the reservoir for mixing (this improves material charging and material dispersion which aid in reducing dusting).

The magnetic brush development station 10, according to this invention, provides for replenishing the housing reservoir with a fresh supply of marking particles for the developer material as required. A multi-point replenishment system allows for greater total throughput of material while maintaining a minimal amount of fresh marking particles being added at any one point. This allows the marking particles to be mixed into the developer material much quicker and can subsequently get triboelectrically charged much quicker. This aids in reducing dusting and maintaining a uniform concentration of marking particles throughout the sump.

Figure 7:
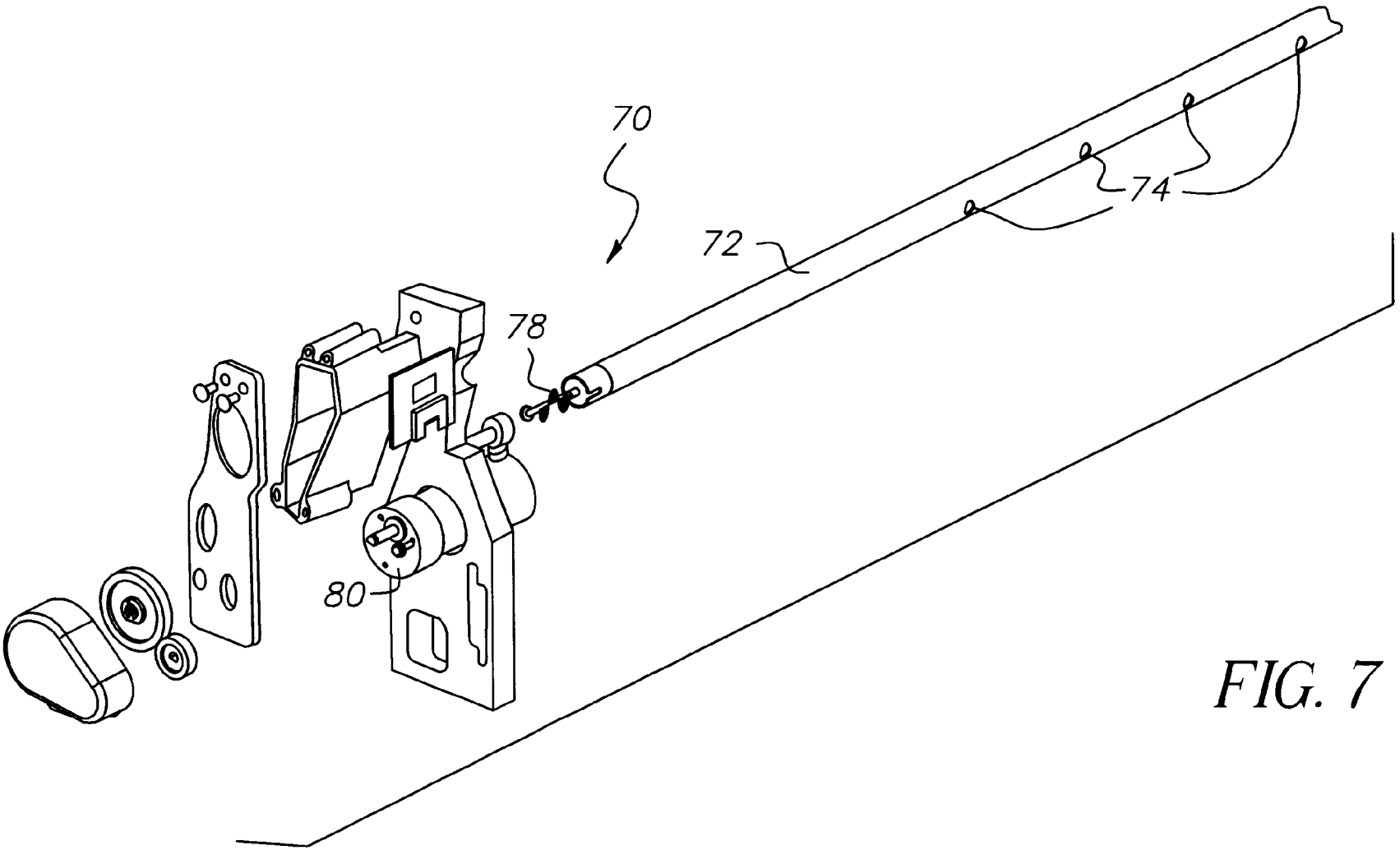
FIG. 7 is a view, in perspective and partially exploded, of the multi-port replenisher system of the magnetic brush development station of FIG. 1.

The multi-port replenishment system, designated in FIG. 7 by the numeral 70, includes a tube 72 defining a series of ports 74. The ports 74 are at a specific angle and varying size so as to allow an equal amount of material to pass through all the replenishment ports. Accordingly, marking particles being introduced to the housing 12 of the development station 10 trickle out of the ports 74. Any excess material left is exhausted though the replenishment dump port (see FIG. 9). Having the material dispersed in small controlled amounts via the plurality of ports 74 allows the material to mix with the material already present quicker than previously found in prior development stations. The quicker mixing of the material also provides quicker charging of the material which, in turn, causes less dusting. A twisted steel and nylon fiber auger brush 78 located in the tube 72 provides the transportation of the material along the tube. The auger brush 78 is driven by an independent motor 79 through a gear pair so as to move material at a desire speed though the tube.

The independent motor 79 of the multi-port replenisher 70 is connected to main replenisher motor for the development station 10 electrically, and logically, so that the two are working in conjunction with each other. When operation of the main system replenisher motor is initiated, the multi-port independent motor 79 is also initiated. The multi-port replenishment auger brush 78 is running at twice the speed as the main system replenisher to prevent the multi-port chamber from over filling.

Figure 8:
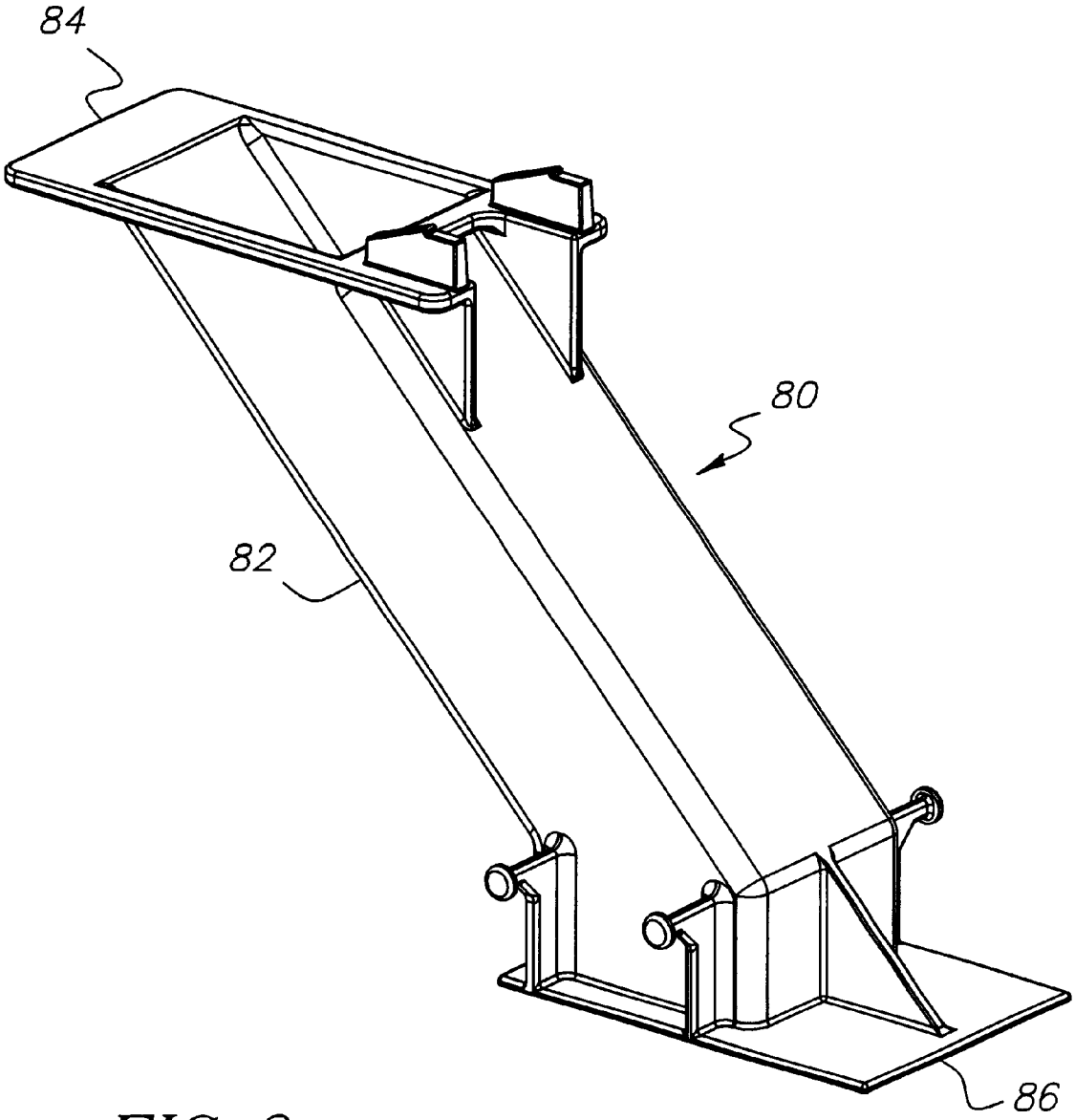
FIGS. 8 and 9 respectively show a developer material dump device and its association with the magnetic brush development station of FIG. 1.
Figure 9:
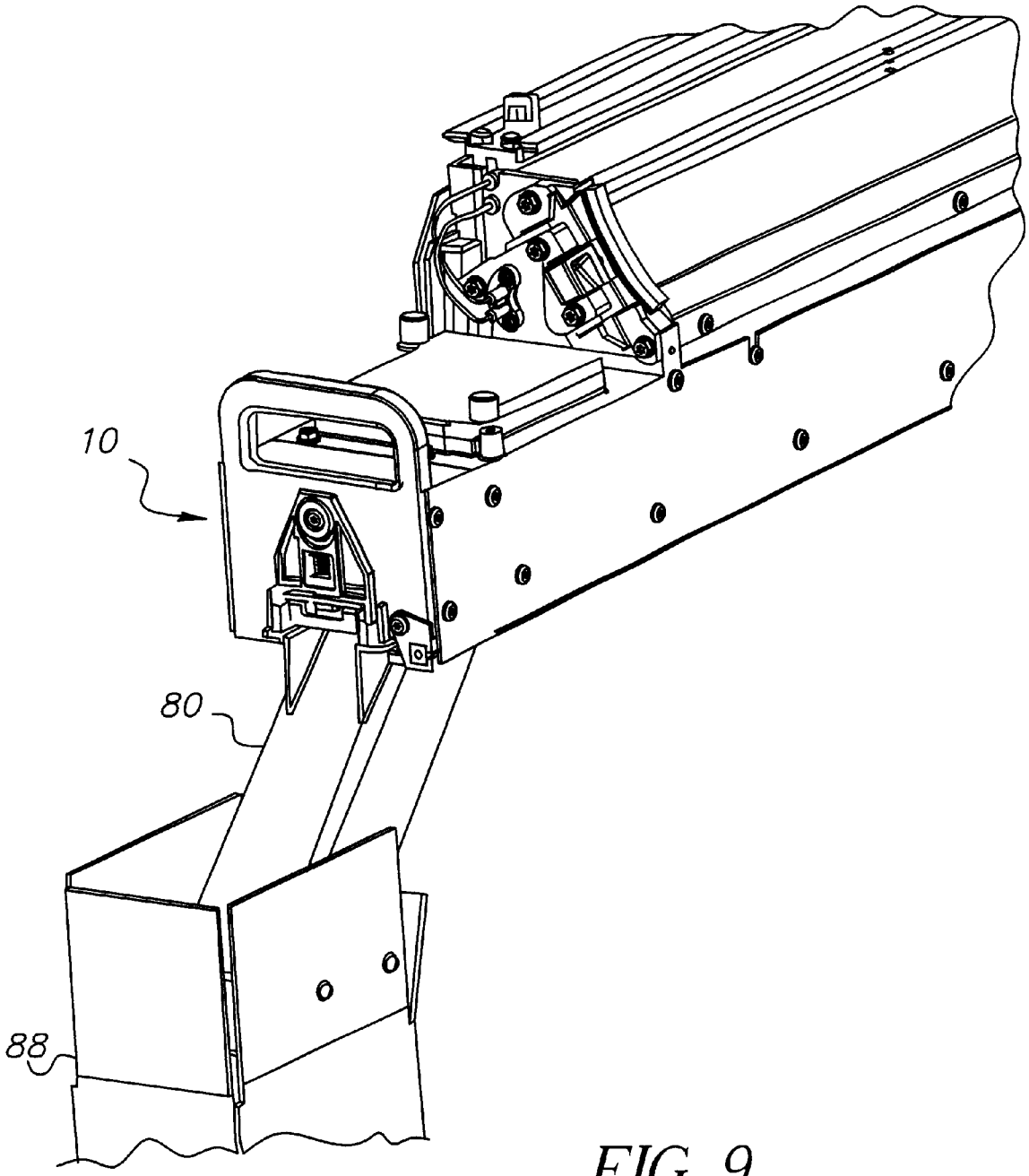
Figure 10:
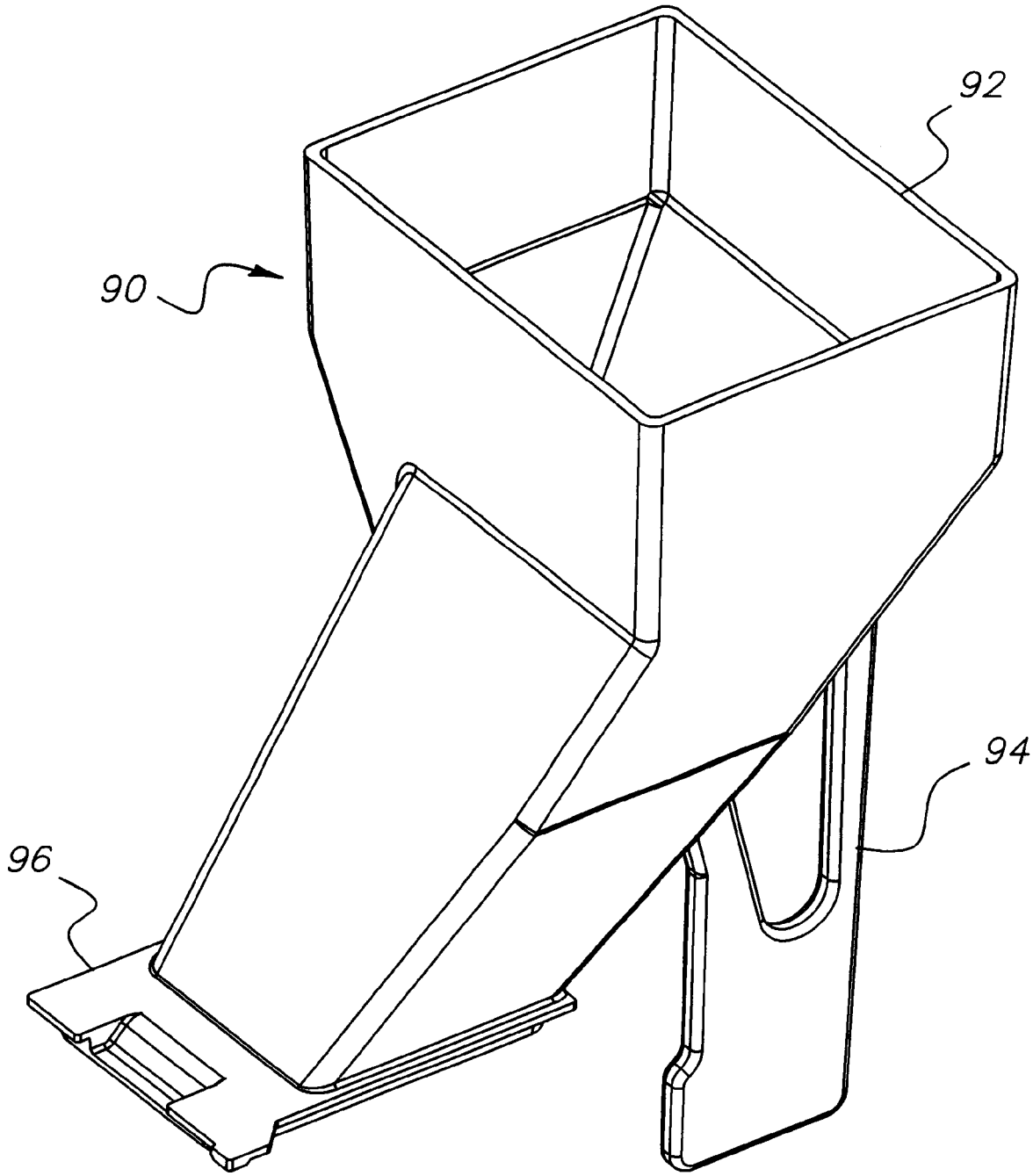
FIGS. 10 and 11 respectively show a fill aid and its association with the magnetic brush development station of FIG. 1.
Figure 11:
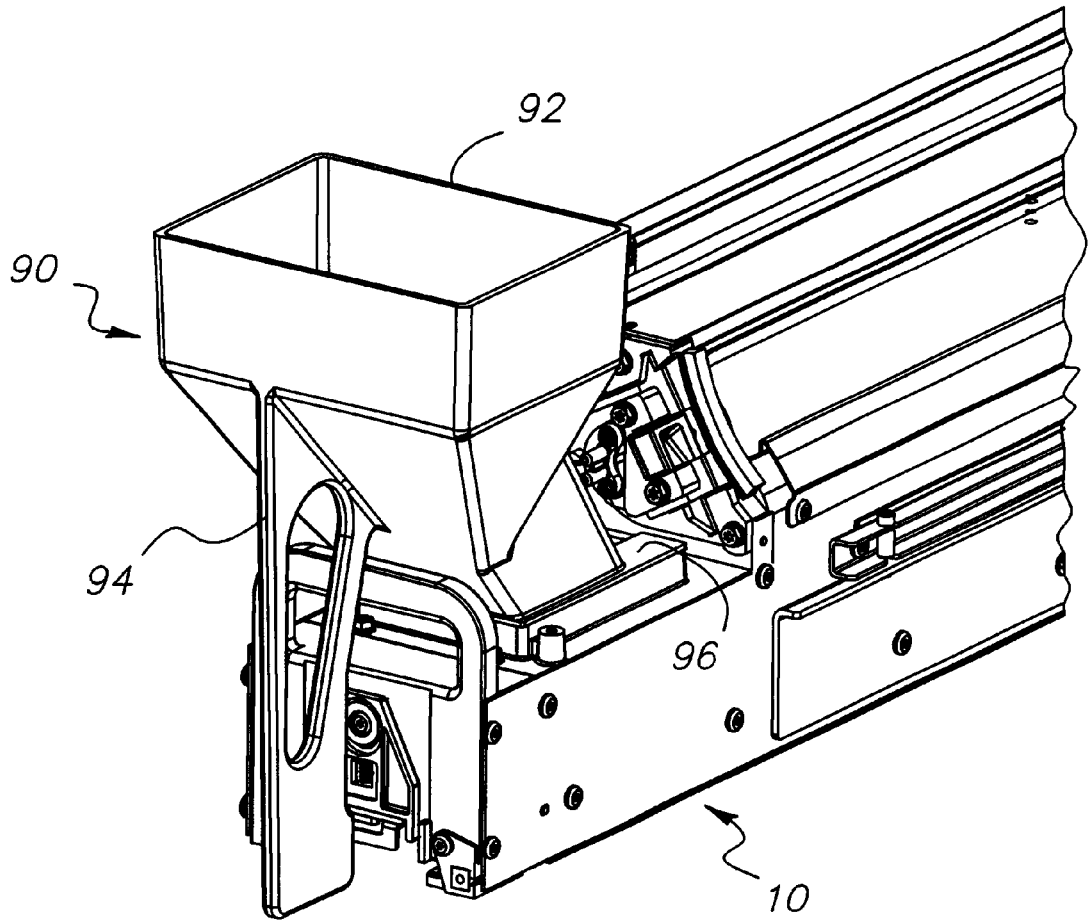

During the process of supplying developer material to the magnetic brush development station 10, according to this invention, expended developer material occasionally needs to be removed from the station. After this used developer material is removed new developer must be added. FIGS. 8 and 9 respectively show a developer material dump device 80 and its association with the development station 10, and FIGS. 10 and 11 respectively show a fill aid 90 and its relation to the development station.

The dump device 80 includes a chute 82 extending between station plate 84 and a collection box plate 86. The dump device 80 (see FIGS. 8 and 9) is installed in operative relation with the development station 10 by engaging the station adjacent to a dump door 85 by the station plate 84. The act of installing the dump chute unlatches the dump door 85 and allows the dump door to be opened so that used developer material will be able to drop through the chute 82 into a collection bag and/or box 88 which is attached to the chute by suitable features. The latch, which allows the dump door to open, also is fashioned to retain the dump chute in the correct position in the developer station. The collection box plate 86 fits into the opening of the collection box 88. The box can then be hung from the chute 82 to collect the used developer material. This enables the developer material to be dumped from the station 10 without operator intervention. The plate 86 prevents developer dust from escaping the collection bag/box 88.

After the developer material is removed from the magnetic brush development station 10, the dump door 85 is closed and the dump device 80 is removed from the station. The fill aid 90 (see FIGS. 10 and 11) is then utilized to supply developer material to the station 10. The fill aid 90 includes a hopper 92, handle 94, and fill plate 96. The fill aid is installed by removing the fill cover and placing the fill plate 96 in the fill opening. The fill plate has a feature 97 to actuate the fill switch. This switch indicates either a fill cover or a fill plate is in place and the mixer augers 28 can be actuated to mix new developer material as it enters the development station reservoir. The fill opening in the developer station and the fill plate 96 have corresponding features which prevent the fill aid from tipping or spilling inadvertently. The handle 94 of the fill aid has a feature which is intended to assure the dump door of the station is closed prior to placing new developer in the station.

With the magnetic brush development station 10 according to this invention, it is necessary to readily insert and remove the station from the reproduction apparatus for service, repair, or replacement. It is also required that the development station be engaged in the reproduction apparatus in a repeatable and reliable method relative to other machine subsystems and components to very tight specifications. Accordingly, as best shown in FIGS. 12–14, there is provided a low friction mechanism 100 including a sliding rail 102 suspended and guided by a plurality of rods 104. The sliding carriage with elongate flanged bearing pockets (see FIG. 6) allows for gimbaled alignment to a skewed photoconductor drum. The center rod of the plurality of rods 104 guides the carriage movement direction and the two outside rods maintain levelness. A camshaft assembly 103 driven by an electrical actuator motor is captured between two components of the side plate assembly 105 and provides the mechanism for transporting the sliding rail 102. The camshaft position is controlled through the use of two solid state micro switches and a cam position coupling. As the cam is rotated from a disengaged position to an engaged position it pushes against the detented cam retainer plate 106 of the sliding rail assembly. As the sliding rail travels to its engaged position, the gimbaled load arm 107 mounted to the side plate 105 is deflected creating a spring force to push the toning subsystem into position. A positive vertical lift force is achieved through the use of two angled push pads, 108 mounted on the load arm and corresponding angled wedge mounted to the toning station. (The station must be lifted into position due to lack of compliance in the downward direction). The sliding rail 102 also contains a track that the subsystem slides on and is guided by while it is being inserted into the machine until all electrical and mechanical interfaces are met. The detented cam retainer plate 106 provides a nesting force so that the camshaft assembly 103 doesn't rotate away when the mechanism is in the engaged position.

As noted, environment for the magnetic brush development station 10, according to this invention is one of high potential contamination. Accordingly, reliable electrical contact is needed from a power source to the biased developer roller 14 within the development station, particularly since the development station must periodically be removed from the normal operating position within the reproduction apparatus (as discussed with reference to FIGS. 12–14). There is therefore provided an assembly 110 (see FIGS. 15–17) including a pair of brushes 112 that would contact a conductive surface on the inside of the developer roller 14, a location substantially free of contamination. The two-brush arrangement is used so that the electrical flow could be monitored entering and exiting the roller to detect voltage bias shorts and intermittent interruptions, if they occurred. The two brushes would be packaged together in a replaceable cartridge 114 that would pass through the center of the developer roller inner bearing race 116 and contact a smooth, clean, conductive disc 118 pressed in the roller gudgeon.

The cartridge 114 houses two spring-loaded brushes 112. The brushes as assembled in their replaceable cartridge 114 slide in close tolerance holes to ensure freedom of axial motion. Also when assembled the springs are preloaded to allow the brushes 112 to maintain contact with the conductive roller disc 118 with a constant force and to allow this force to continue as the brushes wear during use. The assembly 110 is supported and aligned in a recess pocket of the developer roller mount 120 and secured with two screws 122. The brushes 112 that extend from the cartridge 114 align with two corresponding close tolerance through holes in the roller mount 120. These holes support the brushes as they extend inward and contact the conductive disc. The bias brush assembly 110 has two in line connectors that provide ease of assembly and replacement.

Further, with the magnetic brush development station 10 according to this invention, it has been recognized that as demands for image quality from modern reproduction apparatus become more stringent, the mechanical operating window for proper image development has typically become smaller. A constant struggle exists between spacing of a developer roller to the photoconductor surface and manufacturability, reliability, and cost of the development station. In addition, concerns over flake and agglomerate generation compel novel techniques of removing developer material from a developer roller for recharging with fresh developer material to be implemented.

There have been many attempts at different ways to control developer nap thickness on the developer roller 14 as a way to decrease sensitivity to developer roller/photoconductor spacing. If the developer nap is too thick developer material can leak away from the ends of the magnetic core of the developer roller resulting in contamination of other areas of the electrophotographic reproduction apparatus. If the developer nap is too thin there may not be enough toner present to enable high quality development. Past attempts at controlling the developer nap thickness on the developer roller have included slots in tubes or plates and metering skives. The slot width or skive gap and its relationship to the developer roller must be tightly controlled if the developer nap is to be controlled.

With the magnetic brush development station, as discussed above a rotating developer roller shell 18 and magnetic core 16 are utilized. In this alternate embodiment shown in FIG. 18, a pre-skive 130 is utilized with a metering skive 132 in place of skive 22 of FIGS. 1 and 2. To facilitate recharging of the developer material with new marking particles, the magnetic core 16 of the roller 14 is placed eccentrically inside the developer roller shell 18 allowing developer to fall off the shell when it reaches a region of lower magnetic field. This eliminates the need for a skive to remove developer from the roller and the toner flake and agglomerate generation that normally accompanies such design.

The important part of this invention is the orientation of the metering skive gap 132*a* to developer roller 14. The metering skive gap is positioned at the point of the lowest magnetic filed strength from the developer roller's magnetic core. This position significantly decreases the sensitivity of developer nap height to the metering skive gap.

The development station 10, according to this embodiment of the invention, has as described above developer mixing elements, to thoroughly mix and charge developer, and a magnetic transport roller to transport developer from the mixing zone to the development roller. As noted magnetic core 16 is positioned such that its center of rotation is not the same as the developer roller shell 18. This is done primarily to allow spent developer to fall off the developer roller shell when it reaches a region of lower magnetic field thereby eliminating the need for a take-off skive to remove developer from the developer roller and alleviating concerns of toner flake and agglomerate production by a take-off skive. There is a developer pre-skive 130 which allows some amount of developer to reach the developer roller shell 18 from the transport roller. Without this pre-skive a large amount of developer would be delivered to the skiving zone and result in higher drive torque. The developer is then skived a second time by the developer metering skive.

Extreme sensitivity of developer nap height to metering skive gap in other development station designs has been well documented. However, placing the metering skive gap in the region of lowest possible magnetic field from the developer rollers magnetic core decreases that sensitivity by a factor of two to four times. This makes the metering skive gap easier to setup in manufacturing and less sensitive to differences in that skive gap along the length of the developer roller.

The invention has been described in detail with particular reference to certain preferred embodiments thereof, but it will be understood that variations and modifications can be effected within the spirit and scope of the invention.

What is claimed is:

1. A magnetic brush development station for a reproduction apparatus, said magnetic brush development station comprises:

a housing forming, at least in part, a reservoir for developer material, said reservoir having a pressure equalization seal;

a mechanism, associated with said housing for readily moving said housing relative to said reproduction apparatus;

a mechanism for selectively readily replenishing and/or emptying at least one component of developer material with respect to said reservoir, a plurality of augers located in said housing for mixing developer material within said reservoir, a drive for said augers, said drive extending through said housing and having a seal therefor, said drive for said augers includes an easily serviced assembly, said assembly includes a substantially cylindrical housing extending through said development station housing, two bearings positioned in said cylindrical housing with a spacer between said bearings, an auger drive member, and wherein said seal for said drive surround a rotatable shaft connected to an auger, said seal includes a lip seal formed of a material which is able to stretch sufficiently to maintain contact with said shaft while the shaft is being rotated by the drive member, whereby said assembly is robust as to wear and heat generation;

a development roller mounted within said housing for delivering developer material from said reservoir to a development zone, said development roller including a core magnet inside a shell, said core magnet and said shell having relative rotation, said core magnet extending less than the entire length of said development roller such that a developer nap on said shell does not extend to an end of said development roller;

a metering skive, extending the length of said development roller, for controlling the quantity of developer material delivered from said reservoir portion of said housing to said development zone, said metering skive positioned parallel to a longitudinal axis of said development roller at a location upstream in the direction of shell rotation prior to the development zone; and a magnetic seal located in association with said skive at each end of said development roller, the magnetic field of said magnetic seal being sufficient to substantially prevent leakage of developer material from the ends of said development roller.

2. The magnetic brush development station of claim 1 wherein said magnetic seal includes a single pole permanent ceramic magnet, providing a magnetic field with a strength in the range of 400 to 1200 gauss, one end of said single pole permanent ceramic magnet is approximately flush with the corresponding end of said development roller and extends along the longitudinal axis of the development roller such that an overlap exists with said development roller, said single pole permanent ceramic magnet being secured to said metering skive by a metal plate and fastener with an active pole of said single pole permanent ceramic magnet in close proximity to the circumference of said development roller, whereby said metal plate functions to shunt the magnetic field except in the area of said single pole permanent ceramic magnet which faces said development roller.

3. The magnetic brush development station of claim 1 wherein said pressure equalization seal is membrane-type seal placed over a hole defined in said housing, said membrane-type seal allows air flow, caused by pressure differential between inside said housing and the exterior thereof, through said membrane-type seal without carrying developer material dust out of said housing, said membrane-type seal is located in such a position as to cause developer material in said housing to continuously be moving across a surface of said membrane-type seal to continuously clean said membrane-type seal to maintain the efficient operation thereof.

4. The magnetic brush development station of claim 1 wherein with said plurality of augers, augers on the outsides are raised and moved slightly towards the center of the development station to reduce the width of said station while maintaining centerline distances so that auger paddles do not collide.

5. The magnetic brush development station of claim 1 wherein said replenishing mechanism includes a tube defining a series of ports, said series of ports are at a specific angle and varying size so as to allow an equal amount of material to pass through all said ports, whereby marking particles trickle out of said ports and are introduced to said reservoir of said housing.

* * * * *